US006305875B1

(12) United States Patent
Matsumoto

(10) Patent No.: US 6,305,875 B1
(45) Date of Patent: Oct. 23, 2001

(54) NET OF THREE-DIMENSIONAL CONSTRUCTION AND VEGETATION METHOD FOR SURFACE OF SLOPE

(75) Inventor: Koichi Matsumoto, Fukui (JP)

(73) Assignee: Asahi Doken Kabushiki Kaisha, Fukui (JP)

( * ) Notice: Subject to any disclaimer, the term of this patent is extended or adjusted under 35 U.S.C. 154(b) by 0 days.

(21) Appl. No.: 08/765,372

(22) PCT Filed: Apr. 30, 1996

(86) PCT No.: PCT/JP96/01183

§ 371 Date: Jan. 21, 1997

§ 102(e) Date: Jan. 21, 1997

(87) PCT Pub. No.: WO96/35021

PCT Pub. Date: Nov. 7, 1996

(30) Foreign Application Priority Data

May 1, 1995 (JP) ..... 7-107362

(51) Int. Cl.[7] ..... E02B 3/12

(52) U.S. Cl. ..... 405/16; 405/32; 405/33; 405/258; 442/304; 442/318

(58) Field of Search ..... 405/258, 16, 15, 405/32, 33; 442/304, 318; 428/174

(56) References Cited

U.S. PATENT DOCUMENTS

| | | | | |
|---|---|---|---|---|
| 667,699 | * | 12/1901 | Heaton | 442/239 |
| 812,045 | * | 2/1906 | Kellner | 405/32 |
| 3,266,969 | | 8/1966 | Mukansi . | |
| 4,181,450 | | 1/1980 | Rasen et al. . | |
| 4,244,197 | * | 1/1981 | Althammer | 66/19 |
| 4,353,946 | * | 10/1982 | Bowers | 405/15 X |
| 4,472,086 | * | 9/1984 | Leach | 405/258 |
| 4,572,705 | * | 2/1986 | Vignon et al. | 405/16 |
| 4,726,708 | * | 2/1988 | Papetti | 405/16 X |
| 4,804,293 | * | 2/1989 | Varkonyi et al. | 405/258 X |

(List continued on next page.)

FOREIGN PATENT DOCUMENTS

| | | | | |
|---|---|---|---|---|
| 56016730 | * | 2/1981 | (JP) | 405/258 |
| 56020234 | * | 2/1981 | (JP) | 405/258 |
| 58101932 | * | 6/1983 | (JP) | 405/258 |
| 58181922 | * | 10/1983 | (JP) | 405/258 |
| 62121233 | * | 6/1987 | (JP) | 405/258 |
| 62184160 | * | 8/1987 | (JP) . | |
| 03183820 | * | 8/1991 | (JP) | 405/258 |
| 06146292 | * | 5/1994 | (JP) | 405/16 |

*Primary Examiner*—Thomas B. Will
*Assistant Examiner*—Jong-Suk Lee
(74) *Attorney, Agent, or Firm*—Jordan and Hamburg LLP

(57) ABSTRACT

A three-dimensional net includes front and rear base nets interconnected with connecting yarn with a predetermined space therebetween. The front and rear base nets each include braid parts forming a meshed structure which presents mesh openings bounded by intersections of the braid parts, each of the braid parts including at least one wale. The mesh openings of a first of the front and rear base nets is larger than the mesh openings of a second of the front and rear base nets, and the front and rear base nets are connected together by passing the connecting yarns between all the braid parts of the first base net and a corresponding portion of the braid parts of the second base net in positions opposed to the braid parts of the first net. As such, a remaining portion of the braid parts of the second net, which subdivide areas bounded by the corresponding braid portion of the braid parts connected to the first braid net by the connecting yarns, and which thereby form smaller mesh openings in the second net, are not connected by the connecting yarns with the braid parts of the first net. In another embodiment, both the front and rear base nets have mesh openings of equal size, and are connected together by passing the connecting yarns between a portion of the braid parts which bound areas each including at least two mesh openings, a remaining portion of the braid parts subdividing the bounded areas.

18 Claims, 9 Drawing Sheets

U.S. PATENT DOCUMENTS 4,837,387 * 6/1989 Van De Pol ..... 405/258 X
4,904,121 * 2/1990 Hallberg ..... 405/258
5,091,247 * 2/1992 Willibey et al. ..... 405/16 X
5,147,150 * 9/1992 Berkhout et al. ..... 405/258
5,249,893 * 10/1993 Romanek et al. ..... 405/258
5,257,878 * 11/1993 Peterson ..... 405/15
5,449,543 * 9/1995 Bach et al. ..... 405/258 X
5,472,297 * 12/1995 Heselden ..... 405/286
5,817,391 * 10/1998 Rock et al. ..... 428/8.6
5,927,906 * 7/1999 Bach et al. ..... 405/258
6,020,043 * 2/2000 Schreck ..... 428/70

* cited by examiner

NET OF THREE-DIMENSIONAL CONSTRUCTION AND VEGETATION METHOD FOR SURFACE OF SLOPE

TECHNICAL FIELD

This invention relates to a three-dimensional net which can be suitably used widely for various kinds of netting such as vegetation netting for the preservation of slopes and the establishment and stabilization of greenery on slopes, water collection and drainage netting and protective netting for residential areas, netting for protecting rock faces, safety netting for building use, netting for use as a thermal insulating material and netting for sports use and for medical use and so on, as a material for industrial uses such as core materials of cushions and mats and cores for reinforcing various kinds of moldings and the like, and for clothing and various other uses, and to a vegetation planting method for planting vegetation on a slope using this net.

BACKGROUND ART

Conventionally, for example in vegetation planting work with the object of preserving a slope and stabilizing greenery on the slope, a net made of wire netting or synthetic resin material has been set on the slope to prevent sliding of earth and sand and then planting materials such as seeds and topsoil have been blown onto the net. However, with this planting method, when due to wind and rain the planting material has been easily washed away or scattered or has slid away together with earth, the plants have not completely adhered and the objective of establishing greenery has not been achieved.

For this reason, recently, vegetation nets wherein braid parts forming meshes are of a three-dimensional structure such as a wall shape have been proposed (for example in Japanese Unexamined Patent Publication No. H.3-183820). However, in the case of this kind of net, in addition to the fact that the larger the size of the meshes (mesh openings) is made the smaller the effect of preventing earth and sand sliding becomes, there have been problems of poor shape retention of the three-dimensional braid parts, deformation such as bending and collapsing has occurred, the meshes have spread excessively and bulging of the net has occurred, and consequently problems of unsatisfactory earth and sand sliding prevention and vegetation material holding effect have arisen.

When on the other hand the meshes are made too small, in addition to the fact that the net actually obstructs the adhering and rearing of plants, the amount of yarn used increases and the net itself becomes heavy and difficult to handle and also becomes expensive.

Also, in the case of a three-dimensional net knitted with a warp knitting machine such as a double Raschel machine from front and rear base nets and connecting yarns connecting together the two base nets, whereas it is usual to use a relatively soft and extendable monofilament yarn, in some applications such as vegetation netting and cushion materials, relatively hard netting having good shape stability is required.

For example in a vegetation net, as the connecting yarns, which hold the three-dimensional shape of the net, a relatively hard thread having good shape holding is required, and from the point of view of the net setting work it is preferable that the whole net be quite hard and have good shape retention. On the other hand, from the point of view of ease of handling and carrying, a rather flexible net is preferable and it is not desirable that the whole net be made hard.

It is therefore an object of the invention to provide a three-dimensional net which as a result of comprising a net of a small mesh size has good retention of its three-dimensional structure and net shape and is strong and can well maintain characteristics resulting from its three-dimensional structure such as bulging of the net being prevented and furthermore is light and easy to handle and easy to set and can be suitably used as vegetation netting and in various other applications, and particularly to provide a net which when used as a vegetation net or a protecting net for a slope has a superior effect of preventing earth and sand sliding and preventing the runoff and scattering of vegetation material.

Another object of the invention is to provide a net the shape retention of parts forming net mesh spaces of which as a three-dimensional net is good and whose air permeability and water permeability and water retention are excellent, and also to provide a three-dimensional net which by being combined with other materials such as wadding or being combined with sheet materials can be given functions not had by conventional nets.

Further object of the invention is to provide a vegetation planting method for planting vegetation on a slope or the like in which method above-described three-dimensional net are used.

DISCLOSURE OF THE INVENTION

The present invention was made to solve the problems described above, and a first aspect of the invention provides a three-dimensional net made by warp knitting and comprising front and rear base nets and connecting yarns connecting together the front and rear base nets with a predetermined space therebetween, wherein braid parts forming meshes of each of the front and rear base nets comprise one or a plurality of wales, the meshes of a first of the front and rear base nets are larger than the meshes of a second of the front and rear base nets, the front and rear base nets are connected together by the connecting yarns being passed between all the braid parts of the first base net and braid parts of the second base net facing the braid parts of the first net, connecting parts formed by the connecting yarns form net mesh spaces corresponding to the large meshes of the first base net and braid parts of the second base net not connected to the first base net by the connecting yarns form a plurality of small meshes inside the net mesh spaces.

With this three-dimensional net, bending deformation and the like of the connecting parts forming the three-dimensional net mesh spaces can be limited by the braid parts of the first base net forming the small meshes inside the net mesh spaces which do not have connecting yarns attached thereto, the shape retention of the three-dimensional state and the net mesh spaces is good, the net mesh spaces do not expand excessively and bulging of the net when it is set on a slope or the like is prevented.

A second aspect of the invention provides a three-dimensional net similarly made by warp knitting wherein braid parts forming meshes of each of the base nets comprise one or a plurality of wales, the base nets are connected together by the connecting yarns being passed between one in every two or more of the braid parts of each of the base nets, connecting parts formed by the connecting yarns form net mesh spaces larger than the meshes of the base nets and braid parts of the base nets not connected by the connecting yarns form a plurality of small meshes inside the net mesh spaces.

In the case of this aspect of the invention, because braid parts forming the small meshes inside the net mesh spaces which do not have connecting yarns attached thereto exist on both the front side and the rear side, bending deformation of the connecting parts forming the three-dimensional net mesh spaces can be limited by braid parts on both the front side and the rear side, the shape retention of the three-dimensional state of the net and the net mesh spaces is even better and the net mesh spaces do not expand excessively and the connecting parts do not collapse.

Also, in a three-dimensional net of either of the aspects of the invention described above, because the braid parts of the front and rear base nets are made up of one or a plurality of wales the tensile strength of these braid parts is high.

In particular, according to a third aspect of the invention, in a three-dimensional net of either of the aspects of the invention described above the braid parts of the front and rear base nets each comprise chain stitching yarns of one or a plurality of wales and an inlay yarn cross-swing inlaid into this, and as a result the braid parts are even stronger and do not break easily.

According to a fourth aspect of the invention, in a three-dimensional net of any of the aspects described above, the braid parts forming the meshes of the front and rear base nets comprise one or a plurality of wales continuing in the knitting direction and the braid parts are knotted at intervals of a predetermined spacing corresponding to the respective meshes alternately to braid parts adjacent on the left and right in zigzags so that they form polygonal meshes such as square or hexagonal meshes.

When the three-dimensional net is formed in this way, despite being a net having a three-dimensional structure, width expansion adjustment and folding of the net become easily possible and furthermore manufacture by warp knitting with a double Raschel knitting machine becomes easy.

According to a fifth aspect of the invention, in a three-dimensional net of any of the aspects described above, the braid parts of the front and rear base nets between which the connecting yarns pass comprise a plurality of wales and the connecting parts formed by the connecting yarns have a width of a plurality of wales and form a three-dimensional shape which is substantially hollow or has three-dimensional voids and is permeable to air and water.

With a three-dimensional net of this construction, the resistance to compression of the connecting parts forming the net mesh spaces is high, and as a result of this together with the shape holding effect of the braid parts on one or both of the front and rear sides not having connecting yarns attached thereto it is possible to well maintain the three-dimensional state of the connecting parts. Furthermore, the connecting parts themselves have voids inside them continuing in the length direction, and air and water permeability are therefore well maintained.

According to a sixth aspect of the invention, in a three-dimensional net of any of the aspects described above, the braid parts of the front base net are knotted in different positions from the braid parts of the rear base net so that the connecting parts connecting together the front and rear base nets alternately slope to the left and right.

As a result of the three-dimensional connecting parts forming the net mesh spaces sloping alternately to the left and right in this way, when a load or pressure acts on the net in its thickness direction, the connecting parts so act on each other that they prevent each other from falling and as a result of this together with the shape holding effect of the braid parts not having connecting yarns attached thereto the net has excellent compressive strength and shape retention and also has good elasticity. Therefore, excessive compression or crushing of the net when the net is used as embedded in ground is prevented and it is possible to well maintain the characteristics and spaces of the net as a three-dimensional structure and a three-dimensional net.

Therefore, a three-dimensional net of the aspects of the invention described above has both the function of a three-dimensional net of a relatively large mesh size provided by the net mesh spaces and the function of a net of a smaller mesh size, and utilizing these characteristics can be used for various applications, and in particular can be suitably used as a vegetation net used in vegetation planting work for preserving a slope and establishing greenery on a slope and as a safety net or a protective net.

For example, sliding of stones and earth and sand or topsoil or the like and runoff and scattering of planting material can be prevented by means of the connecting parts of the three-dimensional structure forming the net mesh spaces, and sliding of small stones and earth and sand can be prevented with the small mesh parts inside the net mesh spaces. In particular, when a three-dimensional net according to the fifth aspect of the invention, which has voids in the connecting parts, is used as embedded, an aeration effect providing roots of plants with oxygen through the voids in the connecting parts is obtained, and the insides of the connecting parts serve as flow passages and ventilation and water supply and drainage actions are carried out with good efficiency.

According to a seventh aspect of the invention, in a three-dimensional net of any of the aspects of the invention described above, the front and rear base nets are made nets knitted using yarns of different thicknesses and with respective knitting machine gauges made different by a factor of at least two.

In this way, it is possible to knit a base net using a yarn having strength, hardness and resilience which cannot be knitted with the front and rear gauges of the same, for example a thick monofilament yarn, on the side with the coarser gauge, and a three-dimensional net having properties not had by conventional double knitted fabrics can be obtained. Also, this raises the tensile strength of and suppresses extension of the braid parts of the respective base net and the three-dimensional net has excellent shape retention and durability.

According to an eighth aspect of the invention, in a three-dimensional net of any of the aspects described above, yarn strands constituting the front and rear base nets and the connecting yarns comprise a corroding fiber such as a natural fiber, a decomposing chemical fiber or a blend spun fiber consisting of a blend of these with a synthetic fiber.

In this case, because the net corrodes or decomposes with the passing of years, when this net is used for example as a net for planting vegetation on a slope, it is possible to hold a planting material with the net certainly during an initial stage of the establishment of vegetation and furthermore because it corrodes or decomposes with the passing of years the net does not hinder the growth of planted plants. That is, synthetic fibers are not left in the natural world forever and the net is friendly to the environment.

According to a ninth aspect of the invention, in a three-dimensional net of any of the aspects described above, all or a part of yarn strands constituting the front and rear base nets and the connecting yarns are made of a highly water absorbent resin fiber or a blend spun fiber including such a fiber. When this is done, the water retention of the net itself is good and vegetation planting using this net can be carried out well. A three-dimensional net according to this aspect of the invention is particularly suited for establishing greenery on land having poor water retention such as desert land.

According to a tenth aspect of the invention, in a three-dimensional net of any of the aspects described above, all or a part of yarn strands constituting the front and rear base nets and the connecting yarns comprise one of a thermosetting fiber, a thermocontracting fiber and a thermofusing fiber or a blend spun fiber or paralleled fibers including any of these fibers and is heat processed after being knitted.

In this case, as a result of heat processing the net after it is knitted, for example in the case of a thermosetting fiber yarn the yarn hardens and the knit structure becomes more resistant to collapse, in the case of a thermocontracting fiber yarn the yarn contracts and the stitches close and in the case of a thermofusing fiber yarn the yarn fuses and then hardens and the stitches become more resistant to collapse, and therefore in any of these cases the work of setting the net becomes easy and the shape stability of the set net is increased.

According to an eleventh preferred embodiment of the invention, in a three-dimensional net of any of the aspects described above, it is possible to use elastic yarn for all or a part of yarn strands constituting the front and rear base nets and the connecting yarns. In this way it is possible to make a net of a hollow three-dimensional structure having extendibility and compressibility, and an ease of fitting not obtainable with nets in which no elastic yarn is used can be obtained.

According to a twelfth aspect of the invention, in a three-dimensional net of any of the aspects described above, a wadding material, a cushion material or a heat insulating material comprising a natural fiber, a synthetic fiber, a decomposing chemical fiber, a water retaining fiber, a carbon or glass fiber or other fiber or a blend spun fiber including any of these fibers or another material such as fertilizer can be held inserted into the net mesh spaces in any locations or joined to the front and rear base nets and the connecting parts. In this way it is possible to raise the density of the three-dimensional net or make it bulky, and it is possible to increase its water retention or elasticity or heat insulativity and so on according to the requirements of the application. Also, runoff of fine soil and the like can be prevented.

According to a thirteenth aspect of the invention, a three-dimensional net of any of the aspects described above can be been made into a composite structure by being spread open and held in a three-dimensional state and joined to a sheet-form material such as a woven fabric, a nonwoven fabric or paper, a planar or three-dimensional net-form material or a synthetic resin or metal plate-form material.

In this way it is possible to limit the peculiar extendibility and compressibility of the three-dimensional net made by warp knitting by means of a sheet-form material, another net-form material or a plate-form material and raise its tensile strength and shape holding strength and well maintain its air and water permeability, and obtain a net particularly well suited for use as an embedded water drainage net for embankment stabilization. This also makes easy the adhesion of other materials as described above.

According to a fourteenth aspect of the invention, in a three-dimensional net of any of the aspects described above can have a fertilizer, a water retaining agent or a seed germinating agent or the like adhered thereto. By this means, vegetation planting can be carried out just by setting this net on a slope, and the work of vegetation planting can be made simpler and more efficient and more economic.

A fifteenth aspect of the invention provides a vegetation planting method for planting vegetation on a slope or the like, which method comprises setting on a slope or the like a three-dimensional net of any of the aspects described above spread open and held in a three-dimensional state and holding planting material including seeds in the net spaces formed by the connecting parts connecting together the front and rear base nets.

When vegetation planting is carried out in this way, planting material such as seeds and fertilizer, topsoil, water retaining agent and the like can be efficiently held by the relatively large net mesh spaces formed by the connecting parts connecting together the front and rear base nets and runoff and scattering caused by wind and rain can be prevented, and even though the net mesh spaces are relatively large the braid parts forming the small meshes existing inside them prevent sliding of earth and sand of the slope. Also, when topsoil is used, the weight of the topsoil holds down the small base net and as a result the whole net is kept in contact with the slope. Furthermore, plants can adhere to the slope in the net mesh spaces and can grow without being obstructed by the net.

In particular, in this vegetation planting method, in the case of a three-dimensional net of the fifth aspect of the invention, because it has voids in the connecting parts formed by the connecting yarns and therefore has good air and water permeability, at times of rainfall rain is caught in the connecting parts surrounding the net mesh spaces and flows through these connecting parts along the braid parts and as a result the slope does not become soaked more than necessary and sliding of the slope can be effectively prevented.

A sixteenth aspect of the invention provides a vegetation planting method for planting vegetation on a slope or the like using the same kind of three-dimensional net as in the fifteenth aspect described above, which method comprises setting this three-dimensional net on a slope or the like spread open and held in a three-dimensional state and disposing in the net mesh spaces formed by the connecting parts connecting together the front and rear base nets in any position one or more of a vegetation bag filled with planting material including seeds, a solid planting material including seeds, a fertilizer bag, a solid fertilizer and a water retaining material.

In this case, because the net mesh spaces exist over the entire area of the net it is possible to adjust the density with which the planting materials such as planting bags and fertilizer bags are disposed according to the condition of the slope, and it is possible to carry out uniform and effective vegetation planting and establishment of greenery.

BEST MODES FOR CARRYING OUT THE INVENTION

Preferred embodiments of the invention will now be described with reference to the accompanying drawings.

Figure 1:
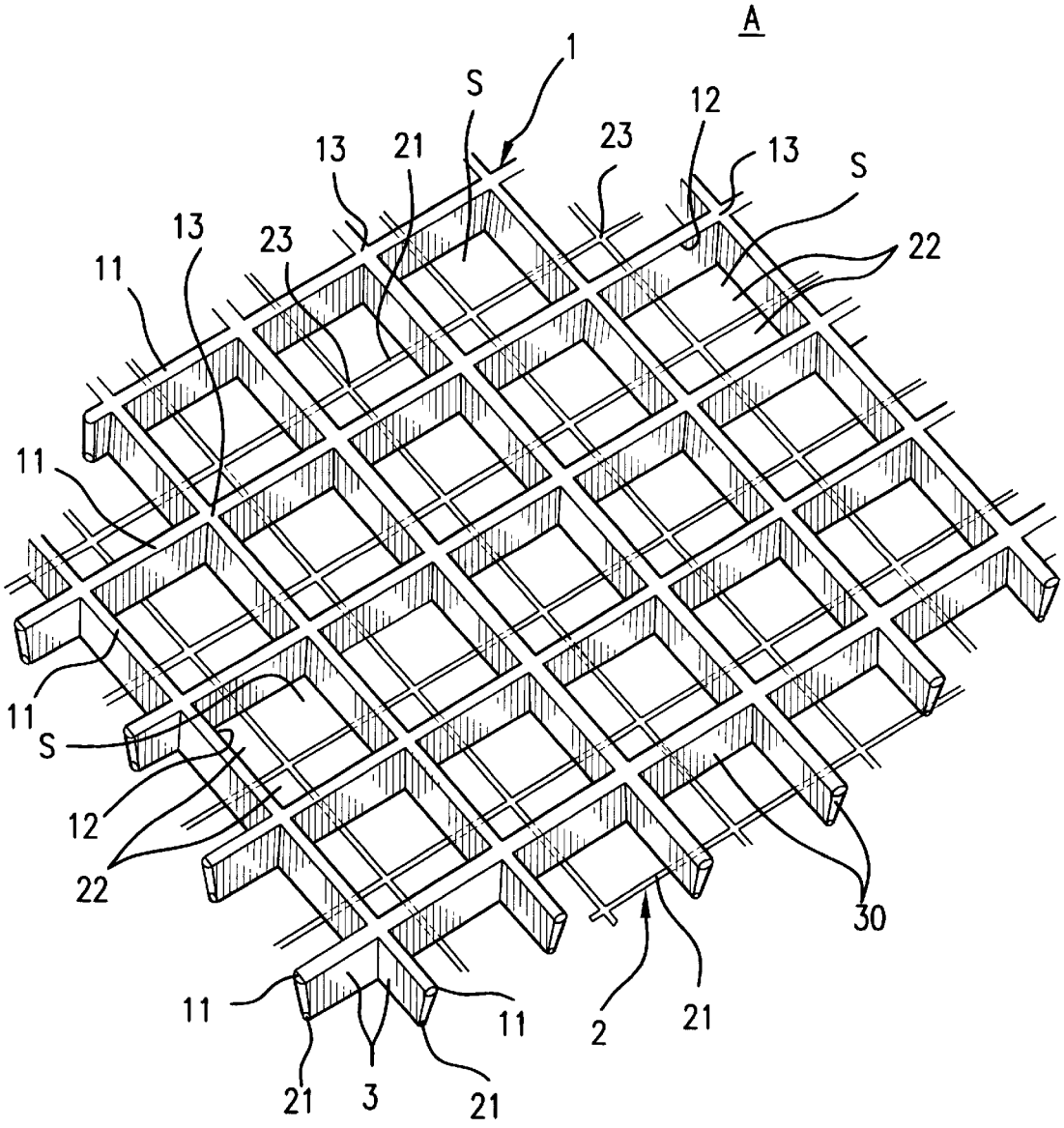
FIG. 1 is a perspective view showing one preferred embodiment of a three-dimensional net according to the invention.
Figure 2:
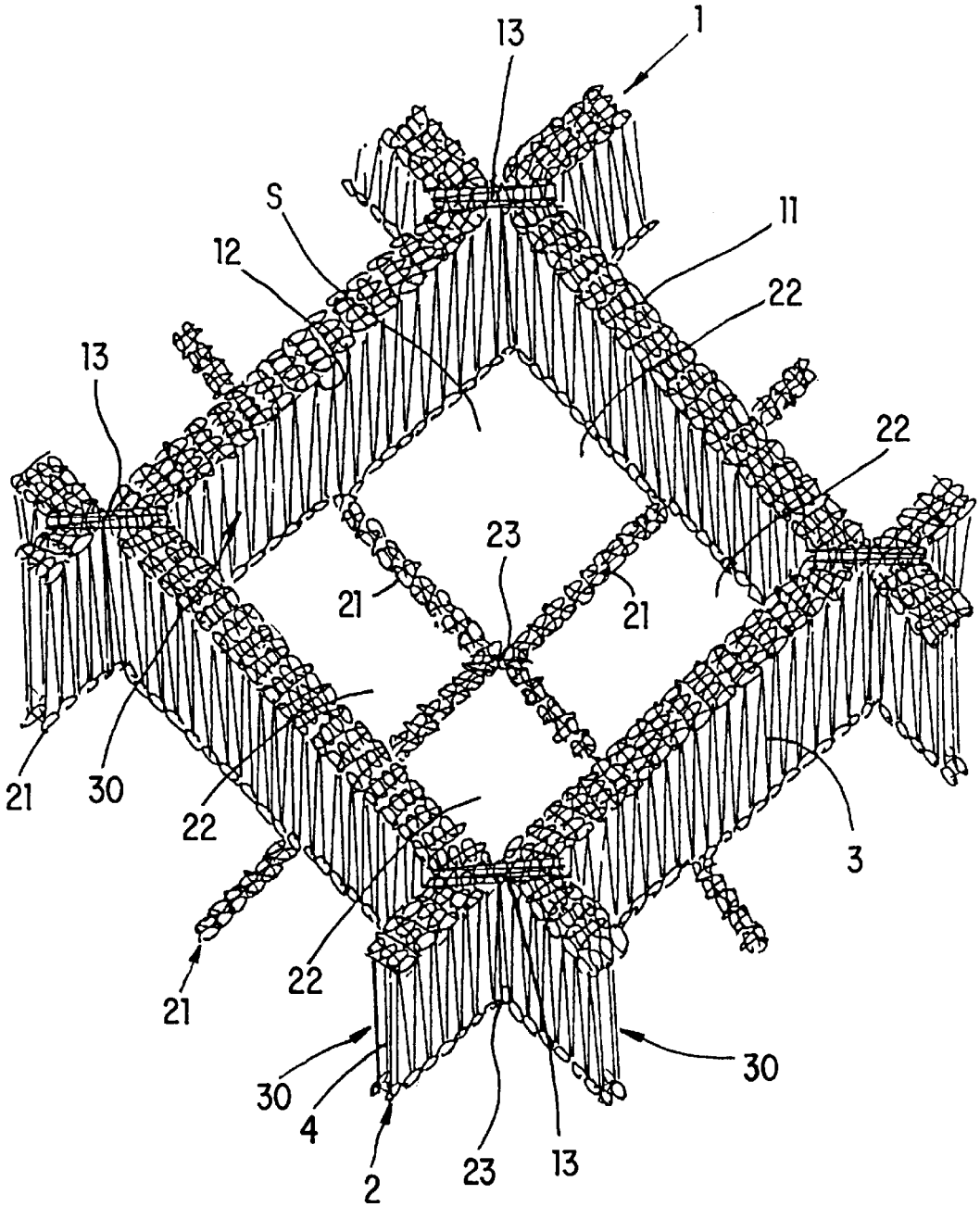
FIG. 2 is an enlarged perspective view of a part of the net shown in FIG. 1.
Figure 3:
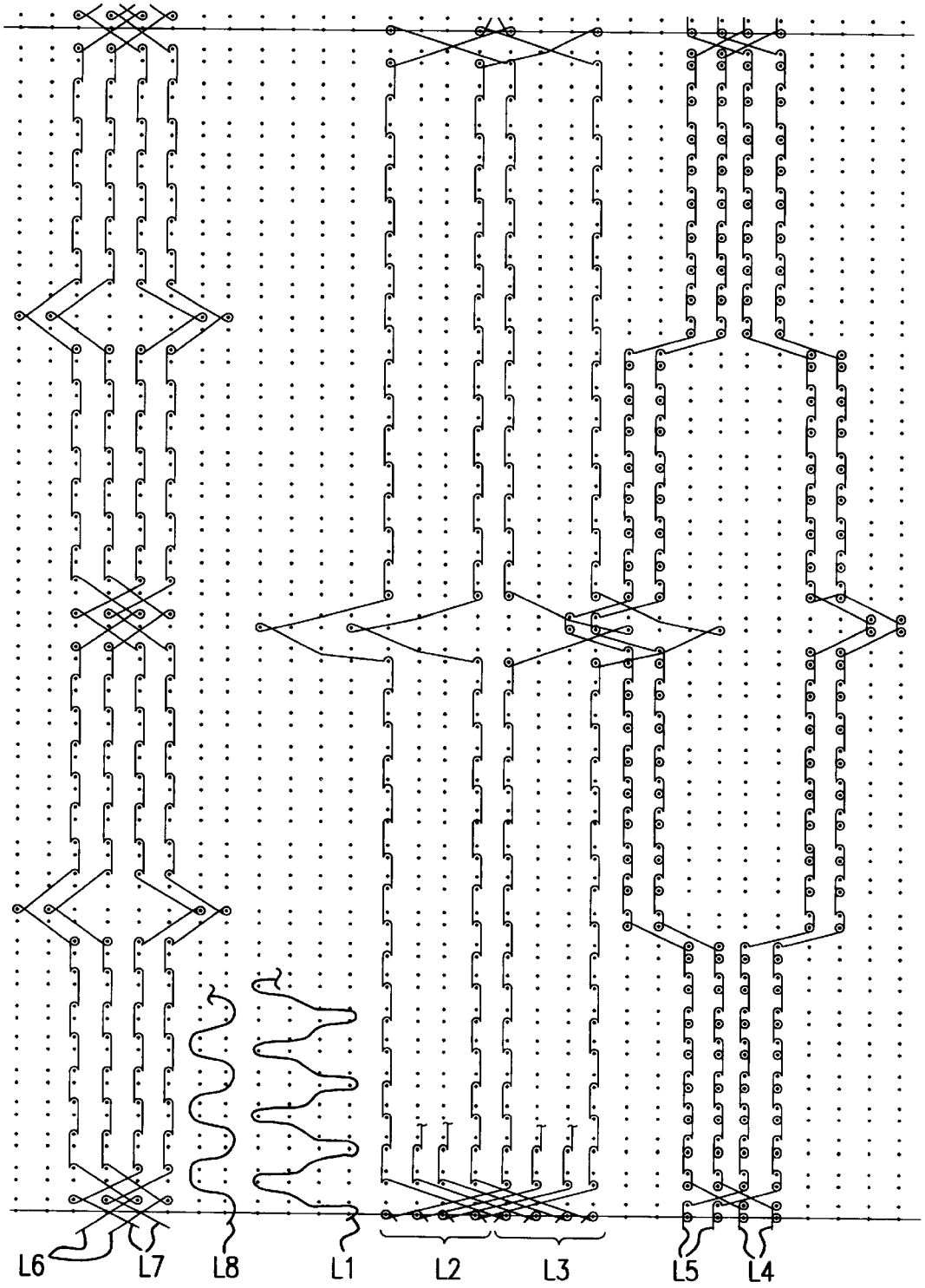
FIG. 3 is a yarn lapping chart showing a specific example of a knit structure of the net.

FIG. 1 is a perspective view of a part of a three-dimensional net A made from synthetic fiber yarns by warp knitting, FIG. 2 is an enlarged perspective view of a part of the net and FIG. 3 is a lapping chart of the knit structure of the net.

In the figures, the reference numerals 1 and 2 denote front and rear base nets 1 mesh webs and 3 denotes connecting yarns connecting together the two base nets 1 and 2 while providing a predetermined spacing therebetween. The reference numeral 11 denotes braid parts forming meshes 12 of the front side base net 1 and the reference numeral 21 denotes braid parts forming meshes 22 of the rear side base net 2, and these braid parts 11 and 12 each consist of one wale or a plurality of wales and are formed in parallel with each other.

The meshes of one of the base nets, for example as shown in the figures the meshes 12 of the front side base net 1, are larger than the meshes 22 of the other base net 2, and the base nets 1 and 2 are connected by connecting yarns 3 running between the braid parts 11 forming these large meshes 12 and those braid parts 21 of the other base net 2 which face these. As a result, connecting parts 30 formed by the connecting yarns 3 form net mesh spaces S corresponding to the large meshes 12, and the braid parts 21 of the other base net 2 which do not have connecting yarns 3 attached thereto form a plurality of small meshes 22 inside each of the net mesh spaces S. In the case shown in the figures, the size of the meshes 22 of the base net 2 is set so that four meshes 22 are formed inside each of the net spaces S.

The braid parts 11, 21 forming the meshes 12, 22 of the front and rear base nets 1, 2 each consist of one or a plurality of wales knitted from chain stitching yarns and an inlay thread cross-swing inlaid into these wales of chain stitching; these braid parts 11, 21 are knotted together with the braid parts 11, 21 adjacent on the left and right alternately at predetermined intervals corresponding to the meshes 12, 22 and continue in the knitting direction in a zigzag, and as a result the meshes 12, 22 each have a polygonal shape such as a square or a rhombus or an approximate hexagon. The reference numerals 13 and 23 respectively denote parts where the braid parts 11, 11 are knotted together and parts where the braid parts 21, 21 are knotted together.

In the case of the preferred embodiment shown in FIG. 1 through FIG. 3, the braid parts 11, 21 of the front and rear base nets 1, 2 each consist of a plurality of wales, and the connecting yarns 3 are passed back and forth between plurality of the wales of each of the front and rear braid parts 11, 21 and therefore have a width extending over a plurality of wales, and the connecting parts 30 formed by the connecting yarns 3 continue in a zigzag in the knitting direction and have a three-dimensional shape which is substantially hollow or has three-dimensional voids and is permeable to air and water in the length direction and also from inside to outside. The reference numeral 4 denotes spaces inside the connecting parts 30.

The three-dimensional net A of this preferred embodiment is made by warp knitting with a double Raschel machine having two needle beds, and a specific example of how it can be knitted will now be described with reference to FIG. 3.

On the front side of the double Raschel machine, by means of two types of chain stitching yarn guides L2 and L3 each alternately guiding four chain stitching yarns and inlay thread guides L1 each guiding an inlay thread through four wales at a time, inlay yarns are cross-swing inlaid into chain stitching wales made by the chain stitching guides L2 and L3 and braid parts 11 of the front side base net 1 consisting of four wales each are thereby knitted, and by stitch forming with the chain stitching threads being shifted through four wales to the left and right alternately at intervals of a predetermined number of courses equivalent to the meshes 12 the braid parts 11 are alternately knotted at knot parts 13 to the braid parts 11 adjacent on the left and right and then the chain stitching threads are returned to their original wale positions. In FIG. 3, the middle two chain stitching threads of each of the two types of chain stitching guides L2 and L3 are shown only in part.

On the back side of the machine, by means of two types of chain stitching guides L6 and L7 each alternately guiding two chain stitching threads and inlay thread guides L8 each guiding an inlay thread through two wales at a time, inlay threads are cross-swing inlaid into chain stitching wales made by the chain stitching guides L6, L7 and braid parts 21 of the rear side base net 2 consisting of four wales each are thereby knitted, and by stitch forming with the chain stitching threads being shifted through two wales to the left and right alternately at intervals of a predetermined number of courses equivalent to the meshes 22 the braid parts 21 are knotted alternately at knot parts 23 to the braid parts 21 adjacent on the left and right and then the chain stitching threads are returned to their original wale positions.

In particular, by being shifted alternately to the left and right at intervals of ½ the number of courses of the intervals at which the braid parts 11 of the front side base net 1 are knotted, the rear side braid parts 21 are alternately knotted to braid parts 21 adjacent on the left and right at positions corresponding to the knot parts 13 of the braid parts 11 and at positions mid-way between these. As a result, the braid parts 21 of the rear side base nets 2 form four small meshes 22 inside each of the meshes 12 of the front side base net 1 as seen from above and of a mesh area ¼ that of the meshes 12.

Also, by means of two types of chain stitching guides L4 and L5 each alternately guiding two connecting yarns 3 these connecting yarns 3 are alternately passed between the two wales constituting a braid part 21 of the rear side base net 2 and two wales among the four wales constituting the braid parts 11 of the front side base net 1 facing this and the two base nets 1, 2 are thereby knitted together by the connecting yarns 3, and at intervals of a predetermined number of courses, at positions mid-way between the knot parts 13, 13 in the braid parts 11, the connecting yarns 3 are shifted to the positions of the two wales of the adjacent braid part 21 in the rear side base net 2 and the positions of the other two wales in the braid parts 11 of the front side base net 1 facing this, and also in the positions of the knot parts 13, 23 of the front and rear braid parts 11, 21 the connecting yarns 3 are shifted transversely together with the shift of the wales of the braid parts 11, 21 there.

By connecting knitting being carried out in this way, the braid parts 11 of the front side base net 1 and only the braid parts 21 of the rear side base net 2 facing these are connected by the connecting yarns 3 over a width of two wales. These connecting parts 30 consist only of the connecting yarns 3 passed between the two base nets 1, 2, and by the knitting machine gauge being suitably set form a three-dimensional shape which is substantially hollow or has three-dimensional voids and is permeable to air and water.

After this knitting, the fabric is suitably extended in the width direction into the form of a net and the meshes 12, 22 of the front and rear base nets 1, 2 are opened and thermally set and the yarns used are thereby given a suitable shape retaining strength and the connecting parts 30 formed by the connecting yarns 3 form net mesh spaces S corresponding to the meshes 12 and the three-dimensional net A shown in FIG. 1 and FIG. 2 is thereby obtained.

In this three-dimensional net A, bending deformation and the like of the connecting parts 30 forming the net mesh spaces S is limited by the braid parts 21 which do not have connecting yarns attached thereto, the shape retention of the three-dimensional state and the net mesh spaces S is good and the net mesh spaces do not expand excessively.

Figure 4:
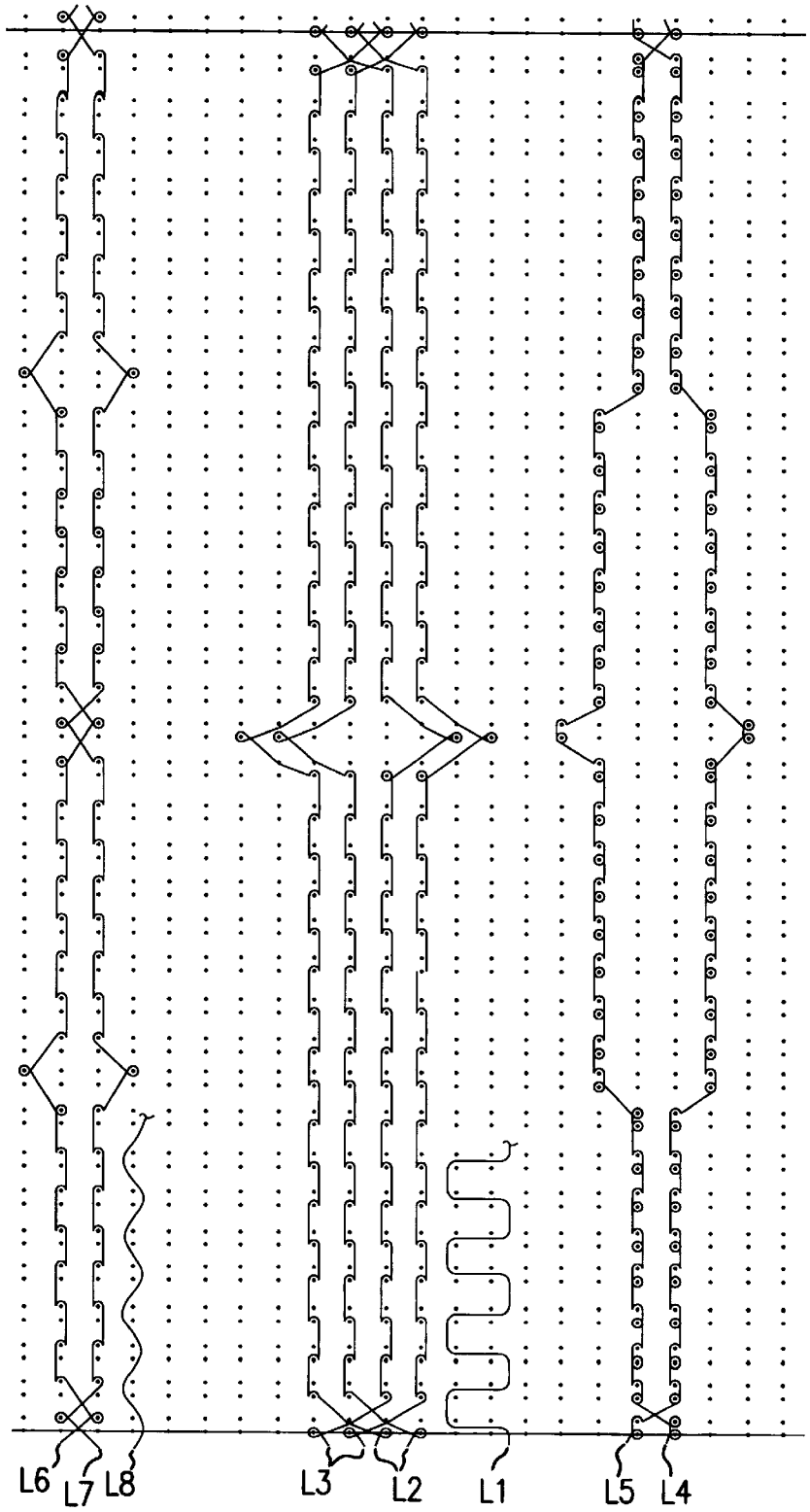
FIG. 4 is a yarn lapping chart showing another example of a knit structure of the net.

FIG. 4 shows another example of a knit structure of a three-dimensional net A of the invention. In this case, the braid parts 11 of the front side base net 1 are made up of two wales of chain stitching yarn and inlay yarn, and the braid parts 21 of the rear side base net 2 are made up of stitching lines of one wale of chain stitching yarn and inlay yarn, and the connecting yarns 3 are passed between the two base nets over a width of one wale. The means by which the braid parts 11, 21 are knotted together and the method of connection by the connecting yarns 3 are the same as in the preferred embodiment described above.

The sizes and shapes of the meshes 12, 22 of the front and rear base nets 1, 2 and the net mesh spaces S in the three-dimensional net A can be set freely by setting the positions of the knot parts 13, 23 of the braid parts 11, 21 and the number of courses therebetween, or by means of the knit structure or adjustment of the expansion width.

Also, it is possible to form more than four meshes inside the net mesh spaces S in the same way, and for example nine meshes can be formed inside each of the net mesh spaces S by two vertical braid parts and two horizontal braid parts.

Instead of having a width of two or more wales (normally 2 to 10 wales), the braid parts 11, 21 of the base nets 1, 2 can each consist simply of one wale. Also, the width of the connecting parts 30 formed by the connecting yarns 3 can be made to a width of one wale or a plurality of wales. In a net wherein the connecting parts 30 have a width of a plurality of wales, the connecting parts 30 themselves have inside them voids continuous in the length direction, and consequently the air and water permeability of the net are kept good, and its resistance to compression is also good.

The spacing between the front and rear base nets 1, 2 (the height of the connecting parts) can be suitably set by adjusting the spacing of the two needle beds of the double Raschel machine. When the connecting parts 30 extend over a plurality of wales, the density of the connecting yarns 3 can be made coarse or made fine by means of the wale spacing (the gauge spacing).

Figure 5:
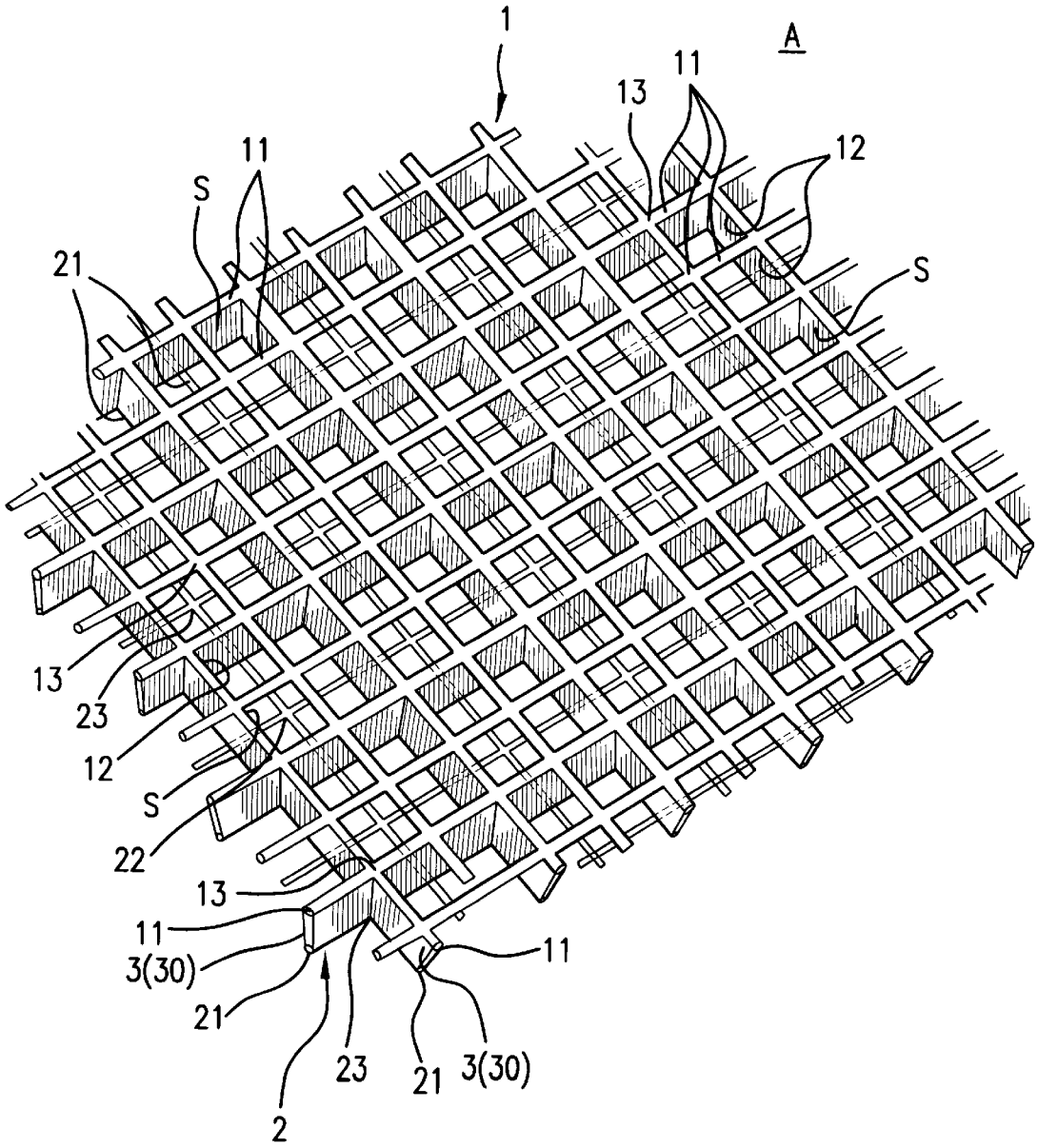
FIG. 5 is a perspective view showing another preferred embodiment of a three-dimensional net according to the invention.
Figure 6:
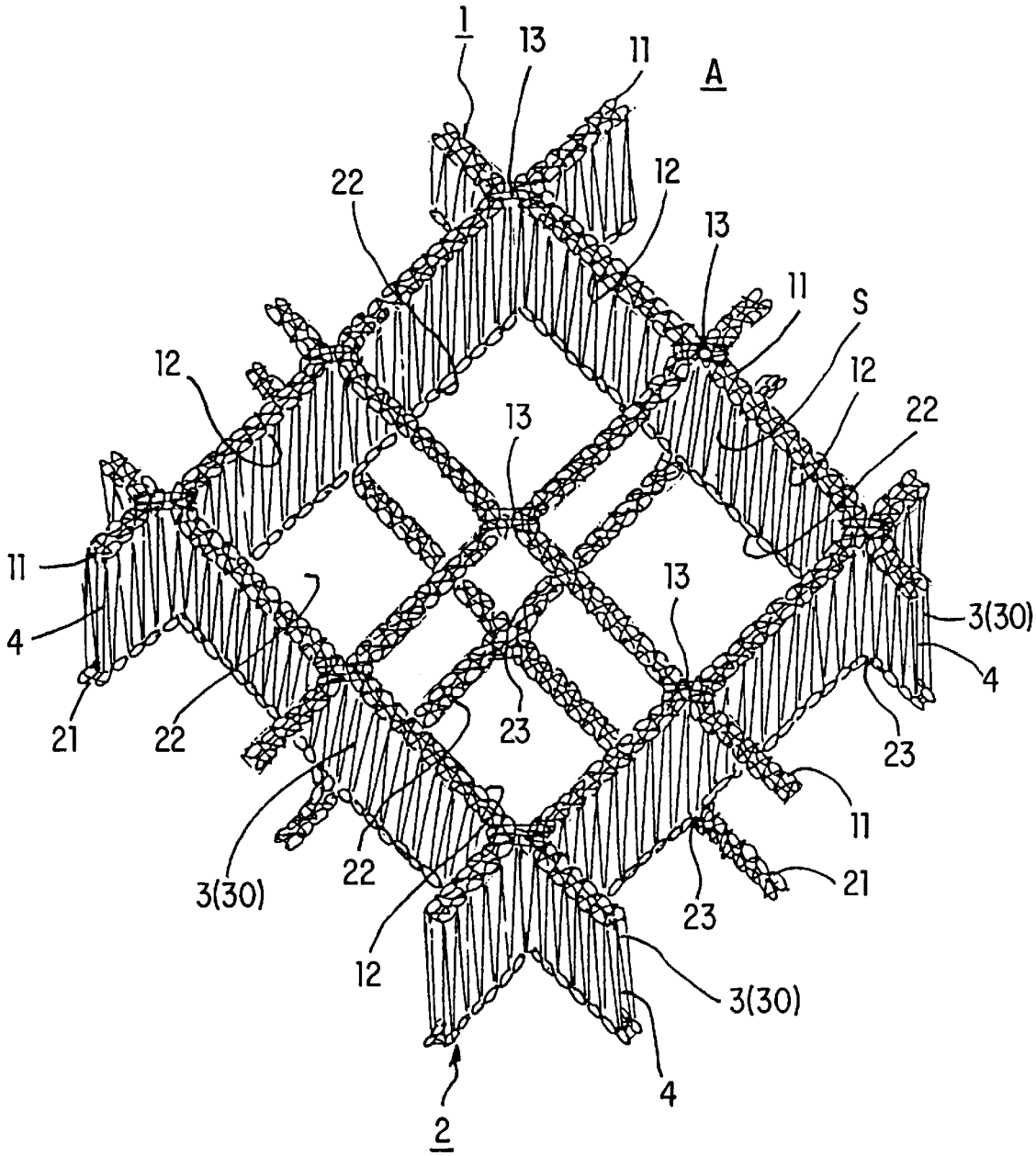
FIG. 6 is an enlarged perspective view of a part of this net.

FIG. 5 and FIG. 6 show another preferred embodiment of a three-dimensional net A of the invention wherein meshes smaller than the net mesh spaces are formed on both the front side and the rear side.

In this three-dimensional net A, as in the preferred embodiment described above, braid parts 11, 21 forming meshes 12, 22 of front and rear base nets 1, 2 are each made up of one or a plurality of wales and one in every two of the braid parts 11, 21 or one in every three or more of the braid parts 11, 21 of the two base nets 1, 2 are connected by connecting yarns 3 passed between the two base nets 1, 2. Net mesh spaces S larger than the meshes 12, 22 of the front and rear base nets 1, 2 are formed by connecting parts 30 formed by these connecting yarns 3, and a plurality of meshes 12, 22 smaller than the net mesh spaces S are formed inside the net mesh spaces S by braid parts 11, 21 of the front and rear net mesh spaces S not having connecting yarns 3 attached thereto.

In the case of this three-dimensional net A, the sizes of the meshes 12, 22 of the two base nets 1, 2 are set so that the braid parts 11, 21 of the front and rear base nets 1, 2 pass between opposite sides of the net mesh spaces S so that they intersect in an X-shape and form four meshes 22.

This net A can be obtained by changing the knitting structure of the two types of chain stitching guides L2 and L3 and the inlay yarn guide L1 knitting the front side base net 1 in knitting of the knit structure shown in FIG. 3 so that they have the same structure as the chain stitching guides L6 and L7 and the inlay yarn guide L8 knitting the rear side base net 2. The reference numerals 13 and 23 denote parts where the respective braid parts are knotted together.

With a three-dimensional net A of this preferred embodiment, deformation of the connecting parts 30 forming the net mesh spaces S is limited by the front and rear side braid parts 11, 21, and it is possible to obtain good shape retention of the three-dimensional state and the net mesh spaces S.

In this preferred embodiment also, as shown in FIG. 5 and FIG. 6, the braid parts 11, 21 of the front and rear base nets 1, 2 are preferably made up of wales of chain stitching yarns and inlay yarns, and the connecting parts 30 forming the net mesh spaces S preferably have a width extending over a plurality of wales and form an air and water permeable substantially hollow three-dimensional shape.

Also, the widths of the braid parts 11, 21 of the front and rear base nets 1, 2 and the shapes and sizes of the net mesh spaces S, the number of front and rear meshes 12, 22 inside the net mesh spaces S, the width of the connecting parts 30 and the overall thickness of the net can be suitably changed in the same way as in the preferred embodiment described above.

Figure 7:
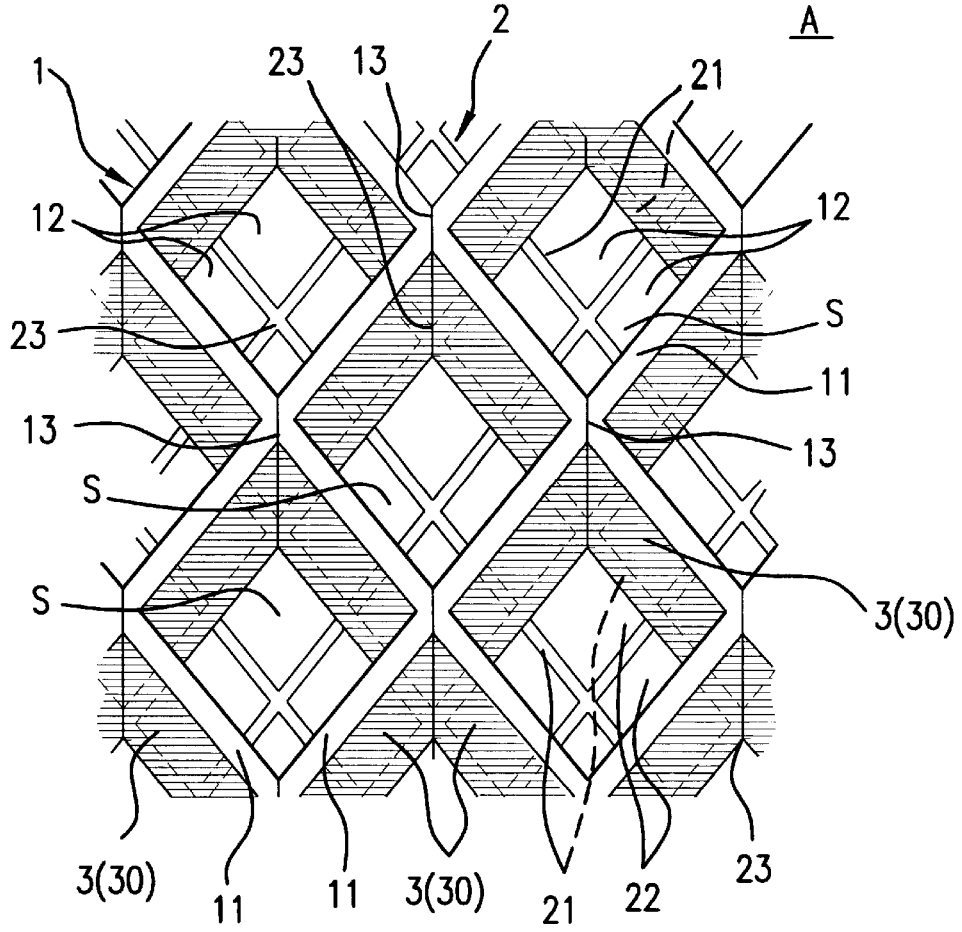
FIG. 7 is a plan view showing another preferred embodiment of a three-dimensional net according to the invention.

In a three-dimensional net of either of the preferred embodiments described above, for example as shown in FIG. 7, by carrying out knitting with the positions of the knot parts 13, 23 of the front and rear braid parts 11, 21, i.e. the positions of the knots created by wale shifting of the chain stitching yarns and inlay yarns constituting the braid parts 11, 21 and the connecting yarns passing between these, mutually front-rear staggered, it is possible to make the connecting parts 30 formed by the connecting yarns 3 slope alternately and obtain for example a truss structure. In this case, the net has excellent compression-resisting strength and shape retention and good elasticity, and its characteristics as a three-dimensional net can be well maintained.

Figure 8:
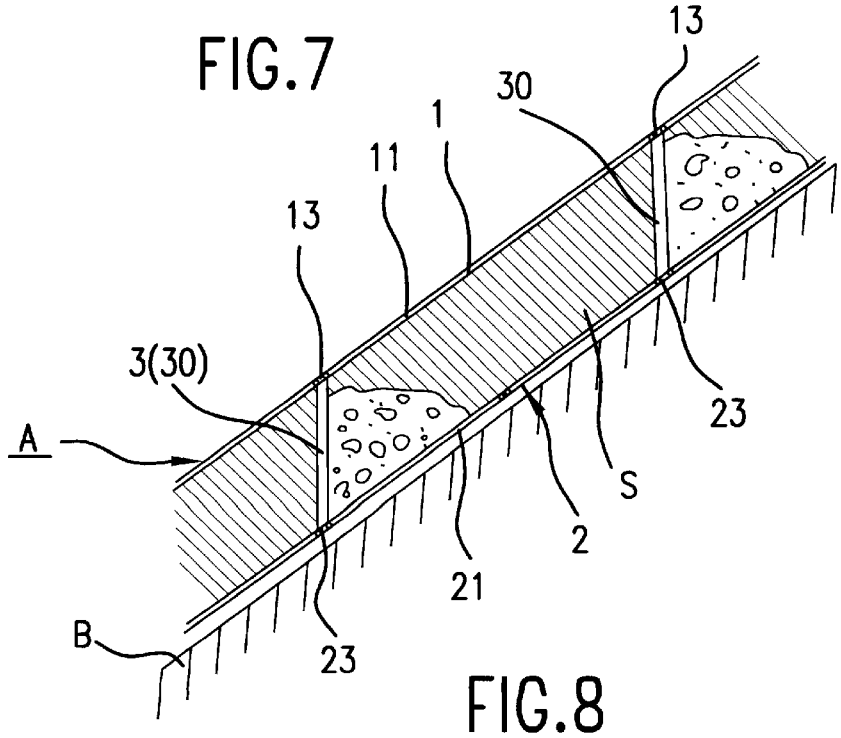
FIG. 8 is a view illustrating the net of FIG. 7 being used for planting work on a slope.

In particular, when this net (A) is used for planting vegetation on a slope B, by the sloping connecting parts 30 being laid on the slope B in the direction shown in FIG. 8, the sloping connecting parts 30 and the slope B become like pockets and can hold vegetation planting materials and earth and sand and the like well.

By suitably changing the numbers of courses and positions by which the positions of the front and rear knot parts 13, 23 are front-rear staggered, the form of the net can be freely set, with for example the knot parts 13, 23 being made to come in front-rear regularly alternating positions or their positions being slightly front-rear staggered.

In the three-dimensional net A, the yarn strands constituting the front and rear base nets 1, 2 are not particularly limited, but normally synthetic fiber yarns having good resistance to water are used, and multifilament yarns or monofilament yarns of nylon and carbon fiber and other synthetic fibers can be suitably used. Of course, yarns of natural fiber can also be used. The connecting yarns 3 are also suitably chosen from among synthetic fiber yarns and natural fiber yarns taking into consideration elasticity and strength so that they are suited to connecting the front and rear base nets 1, 2 and supporting the three-dimensional shape of the net, and mainly from the point of view of three-dimensional structure retention a monofilament yarn is preferably used.

These yarn strands can be suitably given rigidity and resistance to compression by being thermally set after knitting or by synthetic resin processing. Also, the greater the number of connecting yarns 3 connecting together the front and rear base nets 1, 2 is and the higher their density is the greater the resistance to compression and elastic strength in the thickness direction of the net becomes. For a given material such as nylon, the thicker the yarn, the firmer in compression the yarn is.

The thicknesses and materials of these strands are determined taking into consideration the strength, tensile strength and elasticity and so on required for the application. For example, when knitting a vegetation net using a double Raschel machine with a gauge (number of needles per inch) of 14 to 9, for the base nets a yarn of 100 to 2000 denier and preferably 200 to 600 denier is suitably used and for the connecting yarns a yarn of 100 to 3000 denier and preferably 200 to 1000 denier is suitably used.

However, when wanting to knit a net economically, it is possible to make the gauge finer, for example 22 to 18 gauge, and use a finer yarn, and when wanting to increase the physical strength of the net the gauge can be made 4.5 to 3 and a thicker yarn can be used and the strength thereby increased.

Also, the knitting can be carried out with the knitting machine gauge, i.e. the gauge (number of needles per inch) of the front and rear needle beds, needles and guides, of a double Raschel machine knitting the braid parts 11, 21 of the front and rear base nets 1, 2 set to specifications differing by a factor of at least two (for example front 9 gauge, rear 18 gauge) and using yarns of different thicknesses at the front and rear. In this way it is possible to knit using a yarn having strength, hardness and resilience which cannot be knitted with the front and rear gauges the same, for example a thick monofilament yarn, on the side with the coarser gauge, and the strength of that base net can thereby be raised further.

For the strands constituting the front and rear base nets 1, 2 and the connecting yarns it is also possible to use yarns made of corroding fibers such as cotton or other natural fibers, rayon and artificial silk thread, decomposing chemical fibers such as enzyme decomposable fibers decomposed by enzymes, or biodegradable fibers decomposed by microorganisms and bacteria, or blend spun fibers consisting of these blended with synthetic fibers. In this case, the three-dimensional net is corroded or decomposed with the passing of years in use and can be suitably used as a vegetation net.

It is also possible to use a yarn of a highly water absorbent resin fiber or a blended fiber including such a fiber for all or part of the strands constituting the front and rear base nets 1, 2 and the connecting yarns 3 and the water retention of the net can thereby be raised further.

It is also possible to use a yarn to which a highly water absorbent resin has been applied by means such as coating or dipping, or a yarn to which has been adhered or into which has been mixed a fertilizer or a metal such as iron or a chemical or bacteria, according to the object of use of the three-dimensional net.

Also, it is possible to use a yarn of a thermosetting fiber, a thermally contracting fiber or a thermally fusing fiber or a blend spun fiber or paralleled fibers including one or more of these fibers for all or part of the strands constituting the front and rear base nets 1, 2 and the connecting yarns and strengthen the stitch structure by heat processing after knitting to improve the stability of the shape of the net.

Also, by using an elastic yarn for all or part of the strands constituting the front and rear base nets 1, 2 and the connecting yarns it is possible to make a net of a hollow three-dimensional structure having extendibility and compressibility. In this case, it is possible to obtain an ease of fitting not obtainable with nets in which no elastic yarn is used.

In the three-dimensional net described above, it is possible to insert other materials such as wadding, a cushion material or a heat insulating material made from natural fibers, synthetic fibers, decomposing chemical fibers, water retaining fibers or carbon, glass or other fibers, or other materials such as fertilizer, into the net mesh spaces in any locations, or join them to one or both of the front and rear base nets by means such as adhesion or sewing.

Also, in the three-dimensional net A, when necessary it is possible to suitably adhere a synthetic resin such as acryl resin to at least one of the front and rear base nets 1, 2, for example the rear side base net 2 having small meshes in an amount such that it does not impair the air and water permeability of the net, by dipping or laminating means. In this case, the stitches of the warp knitting are held fixed and the respective base net is strengthened and there is no risk of the stitching softening or fraying and the structure becomes more stable. Also, it is possible to adhere a water retention agent such as a highly water absorbent resin to the net by coating means or dipping, and in this case also the water retention of the net is further improved.

In particular, it is also possible to adhere vegetation planting materials including seeds, fertilizers, water retaining agents and seed germinating agents and the like using coating means or adhering means. In this case, vegetation planting work can be carried out just by setting the net on a slope.

Also, according to the application, the three-dimensional net described above can be given a composite structure by being spread and held in its three-dimensional state and joined by means such as stitching or laminating to a woven or nonwoven fabric or paper or other sheet-form material or to a planar or three-dimensional mesh material or to a plate-shaped material made of synthetic resin or metal.

In the three-dimensional net A described above, it is possible to insert pipe members such as pipes with holes or fiber mesh pipes, reinforcing rope or cord-shaped members of wadding, nonwoven fabric or sponge bodies or the like into the insides of the connecting parts 30 extending across a plurality of wales.

In particular, when the net is used as a vegetation planting net, it is possible to insert a band-shaped bag holding planting material including particularly seeds and fertilizers, water retaining agents and seed germinating agents and the like. Also, by inserting a band-shaped bag holding medical products, it is possible to suitably use the three-dimensional net as a net for medical use.

In the three-dimensional net A described above it is also possible to partially dispense with the connecting yarns 3 connecting together the front and rear base nets 1 and 2 and thereby make openings in the side faces of the connecting parts 30 and pass the above-mentioned pipe members or cord-shaped members through into the connecting parts 30 in a direction intersecting with the direction of the braid parts.

The thickness of the three-dimensional net A of the invention and the sizes of the net mesh spaces S and the connecting parts 30 differ according to the application and so on. When the net is to be used as a vegetation net, a net of which the net thickness is in the range 3 to 150 mm, the width of the net mesh spaces S is 10 to 500 mm and the width of the braid parts is 0.5 to 200 mm is generally used, but of course the invention can also be applied to nets of dimensions other than these.

The three-dimensional net A described above can be suitably used widely as vegetation netting used in planting for the preservation of slopes and the establishment and stabilization of greenery on slopes, water collecting and draining netting for residential areas, safety netting for use in construction work and protective netting for use in building, reinforcing material and structure making netting used with blown-on mortar or synthetic resin or the like, netting for medical uses and for sports uses, industrial materials such as core materials and intermediate materials of mats and cushions, and in various other fields. Among these, it can be particularly suitably used in carrying out vegetation planting work on slopes.

Also, by embedding part of this three-dimensional net in concrete or embedding metal fittings or the like attached to parts of the net in concrete with the net spread open and held in its three-dimensional state, it is possible to use the net set on a concrete surface.

A case wherein this three-dimensional net A is used to carry out vegetation planting on a slope will now be described.

Figure 9:
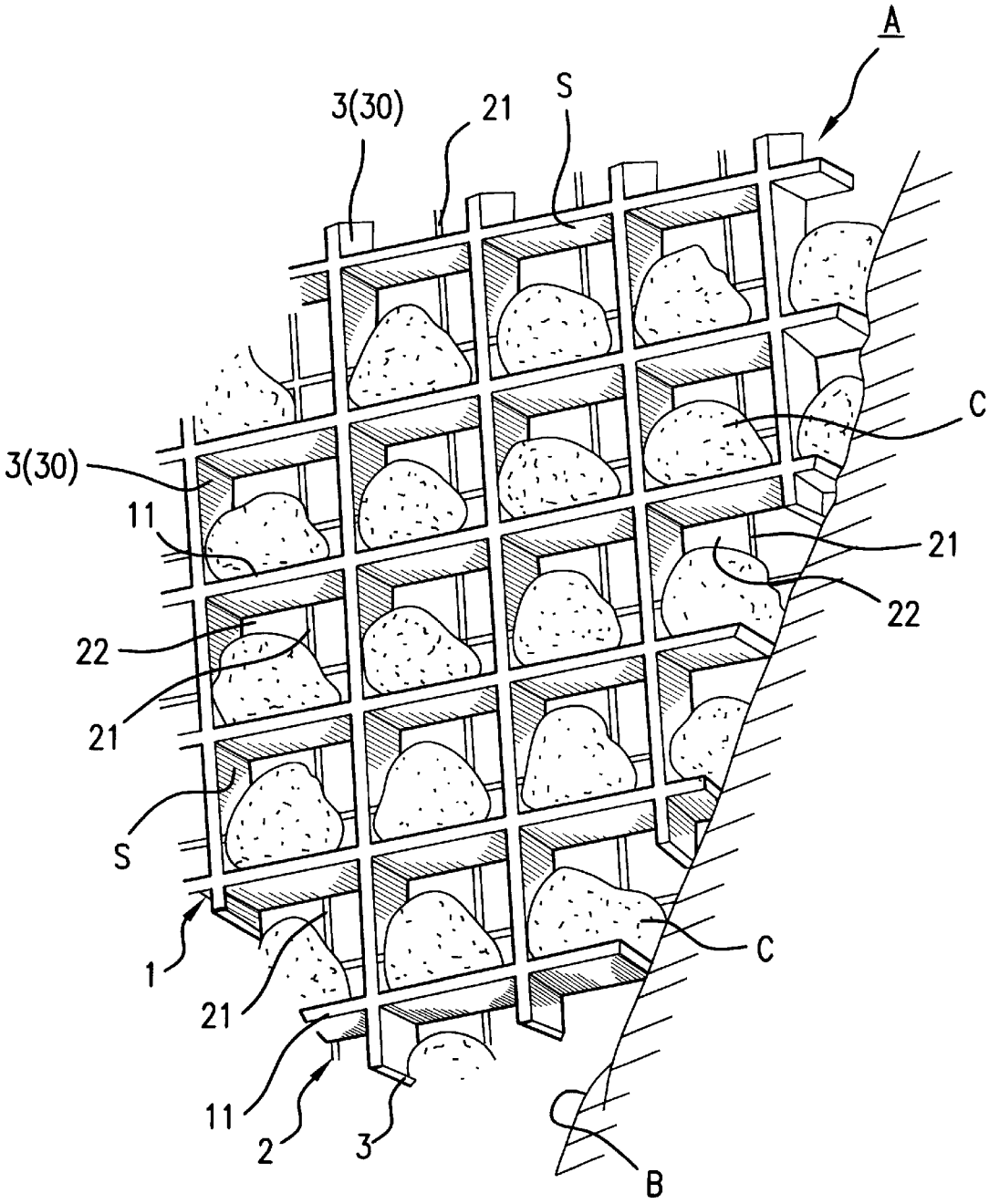
FIG. 9 is a perspective view illustrating a planting method using a three-dimensional net according to the invention.

First, the three-dimensional net A is suitably spread out and extended in the width direction and the connecting parts are brought to their three-dimensional state, and the front side or the rear side is laid so as to be spliced with the slope and fixed with anchor pins or the like. For example in the case of the three-dimensional net of FIG. 1, as shown in FIG. 9 the rear side base net 2 having small meshes is laid so as to be spliced with a slope B.

When the net A has been set in this way, by blowing one or several planting materials such as seeds, fertilizers and topsoil, a water retaining agent such as a highly water absorbent resin polymer, and a soil improver, according to the condition of the slope, from above the net A using blowing means, this planting material C enters net mesh spaces S formed by the connecting parts 30 through the meshes 11 of the front side base net 1 and can certainly reach the slope B. Furthermore, the planting material C is held inside the net mesh spaces S by the connecting parts 30 forming the three-dimensional structure of the net. At this time, because the braid parts 21 not having connecting yarns attached thereto exist inside the connecting parts 30 forming the net mesh spaces S, bending and deformation of the connecting parts 30 is limited and the three-dimensional state of the net is maintained well and the planting material C can be certainly held.

In the case of the net A shown in FIG. 5 and FIG. 6, the shape retention of the three-dimensional shape and the net mesh spaces S is even better, and the planting material C can be held with even better stability.

In this way the planting material C containing seeds and fertilizer and topsoil and the like can be efficiently and certainly held by the relatively large net mesh spaces S formed by the connecting parts 30 connecting together the front and rear base nets 1, 2 and furthermore a supporting action and a windbreaking action of these connecting parts 30 prevent runoff and scattering of the planting material C due to wind and rain. At the same time, sliding of earth and sand of the slope is prevented by the braid parts 21 of the base net 2 of small mesh size existing inside the net mesh spaces S. Also, vegetation can adhere to the slope and grow in the net mesh spaces S.

In particular, when as shown in the preferred embodiments described above the connecting parts 30 have an three-dimensional shape which is substantially hollow or has three-dimensional voids, when it rains, rainwater flows through the connecting parts 30 and the surface of the slope is not soaked excessively, and even if the rear side of the net (the side spliced with the slope) is buried in cases wherein a relatively large amount of topsoil is blown into the net during planting, it is possible to ensure good air water permeability with the connecting parts 30. As a result, planting and establishment of greenery on a slope can be carried out certainly.

Furthermore, because the braid parts 11, 21 of the front and rear base nets 1, 2 are made up of one or a plurality of wales, compared to a case wherein they consist only of simple threads like those of a woven net, they are stronger and there is no danger of them easily breaking and they can be used over long period with good stability.

Figure 10:
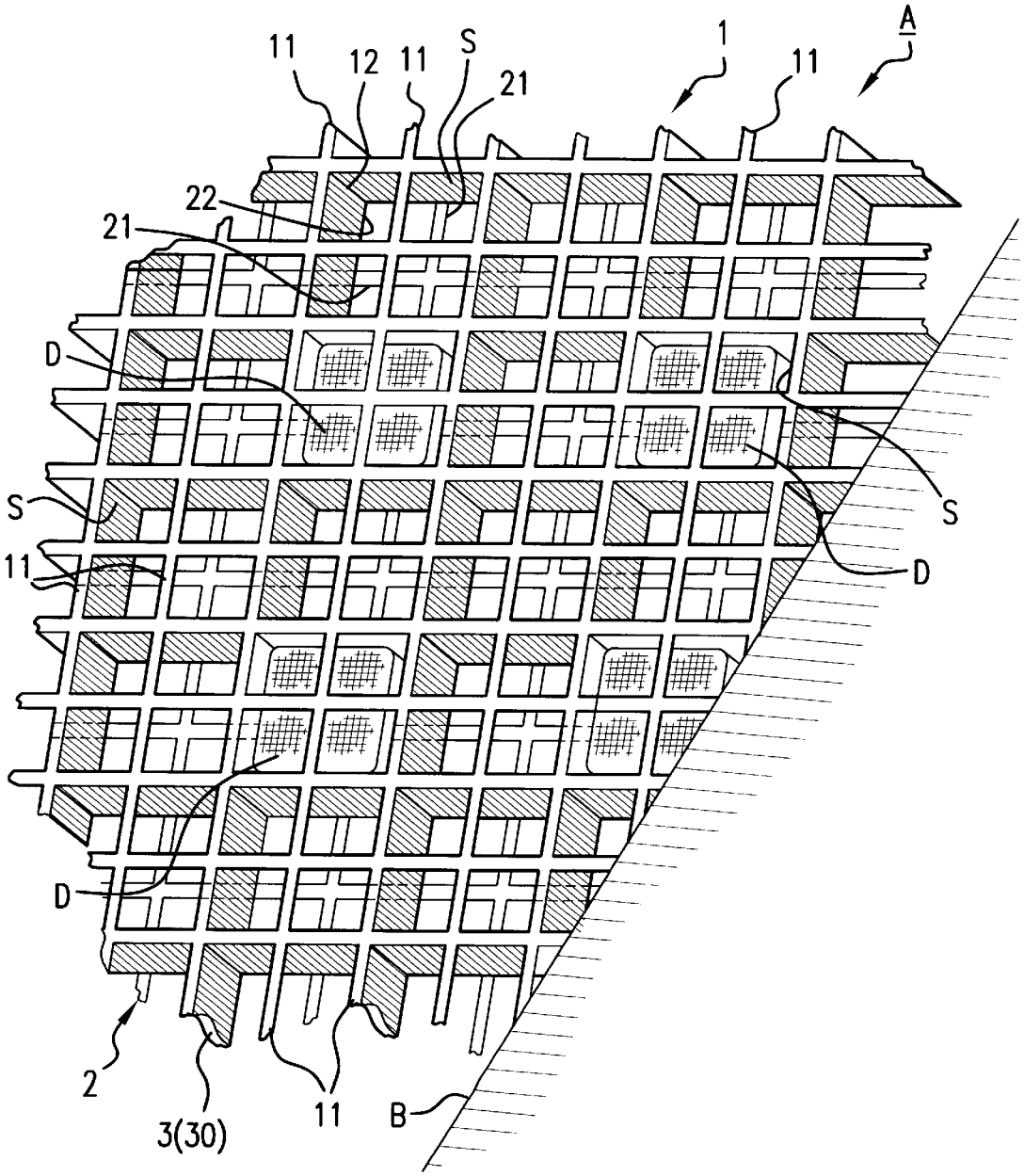
FIG. 10 is a perspective view illustrating another planting method using a three-dimensional net according to the invention.

Also, in a case where a three-dimensional net A is laid and set on a slope B as described above, as shown in FIG. 10 it is possible to carry out planting by disposing planting bags D filled with the above-mentioned planting material or fertilizer bags or the like in net mesh spaces S in any position in the net. Besides the planting bags and the like mentioned above, it is also possible to dispose solid planting material or solid fertilizer or water retaining material in the same way. In this case, when as shown in FIG. 10 braid parts 11, 21 of the base nets 1, 2 not having connecting yarn attached thereto exist on the both front side and the rear side, the planting bags D or the like can be held with no risk of them falling out. Furthermore, because the base nets 1, 2 exist all over the net, it is possible to adjust the density at which the above-mentioned planting bags and fertilizer bags and the like are disposed according to the condition of the slope, and uniformly good vegetation planting and greenery establishment can be carried out.

The above-mentioned planting bags consist of mesh bags or bags made of corroding fibers or water soluble or decomposing fibers or paper or the like filled with planting material such as seeds and fertilizer and when necessary water retention agent and soil improver and so on, and the fertilizer bags contain one or more suitably selected quick effect, gradual effect or late effect fertilizers.

When a three-dimensional net of the invention is used as a vegetation net, it is also possible to fix a vegetation mat consisting of seeds and fertilizer adhered to a sheet material such as a nonwoven fabric made from corroding fibers such as natural fibers or decomposing chemical fibers to the base net having the small mesh size.

Also, in the above-mentioned planting method, when the net A is made of corroding fibers or decomposing chemical fibers or a blended fiber spun from these and a synthetic fiber it is possible to hold the planting material with the net certainly during an initial stage of the establishment of vegetation and after the plants have grown the net corrodes or decomposes and does not hinder the growth of the plants, and removal work also becomes unnecessary.

Also, by using a net made of a yarn of highly water absorbent fibers or blend spun fibers including the same, the water retention of the net itself improves and it is possible to suitably use the net also for establishing greenery on land such as desert whose water retention is poor.

In greening desert by planting vegetation, besides using the above-mentioned three-dimensional net in which highly water absorbent fibers are used, a water retaining material made by packing a highly water absorbent resin polymer held in a nonwoven fabric or a wadding into a bag can be held in the net mesh spaces S or in suitable locations in the internal spaces of the connecting parts 30 having three-dimensional voids, or a highly water absorbent resin can be held by being adhered to the net itself by coating means, and this net can be laid and embedded near the ground surface of desert ground. In this way, it is possible to secure ample water retention over the entire area of the embedded net. Also, as a result of the connecting parts 30 having three-dimensional voids, the water permeability of the area of the entire net also becomes good and greening of desert is made easy.

Furthermore, the three-dimensional net A of the invention described above can also be used as a protective material for cultivating and protecting natural turf. Also, as other uses, a cushion material can be fitted in the net mesh spaces S and the net used as a core material of a mat or the like, or a heat insulating material can be fitted in the net mesh spaces S and the net used as an insulating mat or as a lagging material. Utilizing its space holding characteristic the net can be used as a core material for foam concrete, or by using high tensile fibers such as alamide fibers or carbon fibers in the used yarns the net also can be used as a core material for reinforcement of concrete or synthetic resin board and beam materials.

INDUSTRIAL APPLICABILITY

As described above, a three-dimensional net according to the invention has both the function of a three-dimensional net provided by the relatively large net mesh spaces formed by the connecting parts connecting together the front and rear base nets and the function of a net of meshes smaller than the net spaces provided by at least one of the front and rear base nets, and furthermore the shape retention of the three-dimensional form of the connecting parts connecting the front and rear base nets is good and strong and the net can well maintain characteristics such as air and water permeability and space holding provided by its three-dimensional structure. Also, by selection of the types of yarn and knitting forms constituting the net and by combination with other materials utilizing the three-dimensional structure of the net, the net can be given functions not had by conventional nets.

Therefore, utilizing these characteristics, a three-dimensional net of the invention can be suitably used as vegetation netting and protective netting used in vegetation planting of a slope, and also can be used widely in various other applications such as netting for water collection and drainage and water absorbing netting or as stabilizing and protecting netting of sports grounds and residential areas and so on, protective netting for building use, netting for making structures, and netting for use in fish farming and forestry.

In a planting method of the invention using the three-dimensional net described above, because the connecting parts connecting the front and rear base nets are three-dimensional and form net mesh spaces, it is possible to dispose planting materials such as topsoil and seeds and fertilizer in these three-dimensional net mesh spaces and runoff and scattering of planting materials such as seeds and fertilizer due to wind and rain can thereby be prevented, and this effect combined with the shape holding effect and the effect of preventing sliding of earth and sand of the base net of small mesh size make it possible to easily carry out vegetation planting work for establishing and stabilizing greenery on a slope.

What is claimed is:

1. A three-dimensional net made by warp knitting, comprising:

a first mesh web and a second mesh web, each of the mesh webs being formed of braids comprised of at least one wale, the first mesh web defining first mesh openings larger than second mesh openings defined by the second mesh web;

connecting yarns that connect together the first and second mesh webs with keeping a predetermined gap therebetween, the connecting yarns being passed between each of the braids of the first mesh web and a corresponding one among at least two consecutive braids of the second mesh web, so as to face-to-backwise connect each of the braids of the first mesh web with a corresponding braid of the second mesh web, respectively, while leaving other braids of the second mesh web non-connected;

a face-to-backwise connected network formed of the connecting yarns as well as all the braids of the first mesh web and said corresponding braids of the second mesh webs;

the face-to-backwise connected network defining three-dimensional net mesh spaces as coinciding with the first mesh openings; and face-to-backwise non-connected portions of said other braids on the second mesh web, each of the face-to-backwise non-connected portions being extended from one site to another site of a verge of respective one of the three-dimensional net mesh spaces and being laterally joined, at off and inside of said verge, with next one of the face-to-backwise non-connected portions of substantially identical shape and dimensions, and thereby defining a plurality of the second mesh openings within each said verge.

2. A three-dimensional net made by warp knitting, comprising:

a first mesh web and a second mesh web, each of the mesh webs being formed of braids comprised of at least one wale, and defining mesh openings;

connecting yarns that connect together the first and second mesh webs with keeping a predetermined gap therebetween, the connecting yarns being passed between each first one of at least two consecutive braids of the first mesh web and respective one of at least two consecutive braids of the second mesh web, so as to face-to-backwise connect said each first one of the consecutive braids of the first mesh web with a corresponding braid among the braids of the second mesh web, while leaving other braids of the first and second mesh webs non-connected;

a face-to-backwise connected network formed of the connecting yarns as well as said first ones of braids on the first mesh web and said respective ones of braids on the second mesh web and defining three-dimensional net mesh spaces;

face-to-backwise non-connected portions of said other braids of the first and second mesh webs, each of the face-to-backwise non-connected portions being extended from one site to another site of a verge of respective one of the three-dimensional net mesh spaces and being laterally joined, at off and inside of said verge, with next one of the facet-backwise non-connected portions of substantially identical shape and dimensions, and thereby defining a plurality of the mesh openings within each said verge.

3. A three-dimensional net according to claim 1 or 2, wherein the braids of the first and second mesh webs each comprises at least one wale of chain stitching yarns and an inlay yarn cross-swing inlaid into said at least one wale.

4. A three-dimensional net according to claim 1 or 2, wherein the braids of the first and second mesh webs comprise at least one wale continuing in the knitting direction and each one of the braids is laterally joined with a predetermined interval alternately to left and right adjacent ones of the braids in zigzags for forming polygonal shaped first and second mesh openings.

5. A three-dimensional net according to claim 4, wherein the braids of the first mesh web are laterally joined in different positions from the braids of the second mesh web, such that adjacent straight portions of the face-to-backwise connected network slope left and right alternately with each other.

6. A three-dimensional net according to claim 1 or 2, wherein:

the braids of the first and second mesh webs, between which the connecting yarns pass, comprise a plurality of wales; and each straight portion of the face-to-backwise connected network has a width of a plurality of wales so as to form a substantially hollow three-dimensional shape having three-dimensional voids that are air-conductive and water-conductive.

7. A three-dimensional net according to claim 1 or 2, wherein the first and second mesh webs are knitted using yarns of different thickness and with respective knitting machine gauges made different by a factor of at least two.

8. A three-dimensional net according to claim 1 or 2, wherein yarn strands constituting the first and second mesh webs and the connecting yarns comprise fibers including at least one of a corroding fiber and a decomposing fiber.

9. A three-dimensional net according to claim 8, wherein said fibers include at least one of a natural fiber and a degradative chemical fiber.

10. A three-dimensional net according to claim 1 or 2, wherein at least a part of yarn strands constituting the first and second mesh webs and the connecting yarns comprises at least one of a highly water absorbent resin fiber and a blend spun fiber including the highly water absorbent resin fiber.

11. A three-dimensional net according to claim 1 or 2, wherein at least a part of yarn strands constituting the first and second mesh webs and the connecting yarns comprises one of a thermosetting fiber, a thermocontracting fiber, a thermofusing fiber, a blend spun fiber and paralleled fibers including any of said fibers, and is heat processed after being knitted.

12. A three-dimensional net according to claim 1 or 2, said net being knitted using elastic yarn for at least a part of yarn strands constituting the first and second mesh webs and the connecting yarns.

13. A three-dimensional net according to claim 1 or 2, wherein at least one of a wadding material, a cushion material and a heat insulating material comprising at least one of a natural fiber, a synthetic fiber, a decomposing chemical fiber, a water retaining fiber, a carbon or glass fiber, a blend spun fiber including any of said fibers, and another material, including fertilizer, is held inserted into the three-dimensional net mesh spaces in any locations or joined to either of the first and second mesh webs.

14. A three-dimensional net according to claim 1 or 2, said three-dimensional net being made into a composite structure by being spread open and held in a three-dimensional state and joined to a sheet-form material selected from the group consisting of a woven fabric, a nonwoven fabric, paper, a planar net-forming material, a three-dimensional net-forming material and a synthetic resin or metal plate-form material.

15. A three-dimensional net according to claim 1 or 2, said three-dimensional net having at least one of a fertilizer, a water retaining agent and a seed germinating agent adhered thereto.

16. A three-dimensional net according to claim 1 or 2, wherein yarn strands constituting the first and second mesh webs and the connecting yarns comprise a blend spun fiber including at least one of a corroding fiber and a decomposing fiber blended with a synthetic fiber.

17. A vegetation planting method, comprising:

spreading open a three-dimensional net which includes a first mesh web and a second mesh web, each of the mesh webs being formed of braids comprised of at least one wale, the first mesh web defining first mesh openings larger than second mesh openings defined by the second mesh web, connecting yarns that connect together the first and second mesh webs with keeping a predetermined gap therebetween, the connecting yarns being passed between each of the braids of the first mesh web and a corresponding one among at least two consecutive braids of the second mesh web, so as to face-to-backwise connect each of the braids of the first mesh web with a corresponding braid of the second mesh web, respectively, while leaving other braids of the second mesh web non-connected, the three dimensional net further including a face-to-backwise connected network formed of the connecting yarns as well as all the braids of the first mesh web and said corresponding braids of the second mesh webs, the face-to-backwise connected network defining three-dimensional net mesh spaces as coinciding with the first mesh openings, and face-to-backwise non-connected portions of said other braids on the second mesh web, each of the face-to-backwise non-connected portions being extended from one site to another site of a verge of respective one of the three-dimensional net mesh spaces and being laterally joined, at off and inside of said verge, with next one of the face-to-backwise non-connected portions of substantially identical shape and dimensions, and thereby defining a plurality of the second mesh openings within each said verge; and disposing in the three-dimensional net mesh spaces formed by the connecting yarns connecting together the first and second mesh webs, in any position, at least one of planting material including seeds, a vegetation bag filled with the planting material including the seeds, a fertilizer bag, a solid fertilizer and a water retaining material.

18. A vegetation planting method, comprising:

spreading open a three-dimensional net which includes a first mesh web and a second mesh web, each of the mesh webs being formed of braids comprised of at least one wale, and defining mesh openings, connecting yarns that connect together the first and second mesh webs with keeping a predetermined gap therebetween, the connecting yarns being passed between each first one of at least two consecutive braids of the first mesh web and respective one of at least two consecutive braids of the second mesh web, so as to face-to-backwise connect said each first one of the consecutive braids of the first mesh web with a corresponding braid among the braids of the second mesh web, while leaving other braids of the first and second mesh webs non-connected, the three-dimensional net further including a face-to-backwise connected network formed of the connecting yarns as well as said first ones of braids on the first mesh web and said respective ones of braids on the second mesh web and defining three dimenisonal net mesh spaces and face-to-backwise non-connected portions of said other braids of the first and second mesh webs, each of the face-to-backwise non-connected portions being extended from one site to another site of a verge of respective one of the three-dimensional net mesh spaces and being laterally joined, at off and inside of said verge, with next one of the faceto-backwise non-connected portions of substantially identical shape and dimensions, and thereby defining a plurality of the mesh openings within each said verge; and disposing in the three-dimensonal net mesh spaces formed by the connecting yarns connecting together the first and second mesh webs, in any position, at least one of planting material including seeds, a vegetation bag filled with the planting material including the seeds, a fertilizer bag, a solid fertilizer and a water retaining material.

* * * * *